US008201899B2

(12) United States Patent
Arriola Arrizabalaga

(10) Patent No.: US 8,201,899 B2
(45) Date of Patent: Jun. 19, 2012

(54) IMMOBILIZING SYSTEM, FOR STACKABLE MODULAR FILING CABINETS

(75) Inventor: Pedro Arriola Arrizabalaga, Elgoibar (ES)

(73) Assignee: Ojmar, S.A., Elgoibar (ES)

( * ) Notice: Subject to any disclaimer, the term of this patent is extended or adjusted under 35 U.S.C. 154(b) by 869 days.

(21) Appl. No.: 12/278,944

(22) PCT Filed: Sep. 28, 2006

(86) PCT No.: PCT/ES2006/000544

§ 371 (c)(1), (2), (4) Date: Aug. 8, 2008

(87) PCT Pub. No.: WO2007/099176

PCT Pub. Date: Sep. 7, 2007

(65) Prior Publication Data

US 2009/0021123 A1 Jan. 22, 2009

(30) Foreign Application Priority Data

Mar. 3, 2006 (ES) ..... 200600529

(51) Int. Cl.
*E05C 7/06* (2006.01)

(52) U.S. Cl. ..... 312/221

(58) Field of Classification Search ..... 312/215–220, 312/221, 107.5, 222

See application file for complete search history.

(56) References Cited

U.S. PATENT DOCUMENTS

| | | | | | |
|---|---|---|---|---|---|
| 1,200,882 | A * | 10/1916 | Schaefer | ..... | 312/107.5 |
| 4,768,844 | A * | 9/1988 | Ludwig | ..... | 312/221 |
| 4,772,078 | A * | 9/1988 | Bowyer | ..... | 312/221 |
| 4,884,853 | A * | 12/1989 | Bowyer | ..... | 312/221 |
| 4,957,334 | A * | 9/1990 | Lakso | ..... | 312/221 |
| 5,056,877 | A * | 10/1991 | Westwinkel | ..... | 312/221 |
| 5,199,774 | A * | 4/1993 | Hedinger et al. | ..... | 312/219 |
| 5,599,077 | A * | 2/1997 | Law et al. | ..... | 312/221 |
| 5,671,985 | A | 9/1997 | Grieser et al. | | |
| 5,839,803 | A | 11/1998 | Lizell et al. | | |
| 6,637,843 | B2 * | 10/2003 | Westwinkel | ..... | 312/221 |
| 6,957,877 | B1 * | 10/2005 | Chiu | ..... | 312/221 |
| 7,637,576 | B2 * | 12/2009 | Sevillano Gil | ..... | 312/221 |
| 2002/0014817 | A1 | 2/2002 | Lammens et al. | | |
| 2002/0185943 | A1 * | 12/2002 | Gentili et al. | ..... | 312/221 |
| 2003/0062810 | A1 | 4/2003 | Westwinkel | | |
| 2004/0036387 | A1 * | 2/2004 | Ludwig et al. | ..... | 312/221 |

FOREIGN PATENT DOCUMENTS

| | | |
|---|---|---|
| EP | 1500763 | 1/2005 |
| EP | 1340874 | 8/2008 |
| GB | 2376043 | 12/2002 |
| GB | 2380516 | 4/2003 |

* cited by examiner

*Primary Examiner* — James O Hansen
*Assistant Examiner* — Matthew Ing
(74) *Attorney, Agent, or Firm* — Lucas & Mercanti, LLP

(57) ABSTRACT

Each strip (1) has on each of the ends of its moveable billet (P), mobile blockers (2), (4) each equipped with shafts (2'), (4') facing each other to abutment in the modular stacking of the contiguous files and on each of its own ends, fixed blockers (3), (5) crossed through by the corresponding shaft (2'), (4') of the corresponding mobile blocker (2), (4), so that there is always mechanical continuity between shafts (2'), (4') of two contiguous strips (1) the shafts of which (2'), (4') meet alignedly to abutment, one being supported upon the other in continuity with the billets (P).

4 Claims, 3 Drawing Sheets

IMMOBILIZING SYSTEM, FOR STACKABLE MODULAR FILING CABINETS

The object of the invention is an immobilizing system for stackable modular filing cabinets.

Currently, the use of immobilizing systems for cabinets with drawers or similar, of the type used to file documents of all types, which prevent the overturning of the cabinet when the drawers open, is widespread; there being a vast number of related Patents, among which, for example, and in addition to others, EP1059408; EP0286199; U.S. Pat. No. 4,768,844.

All known immobilizing systems refer to a unit of furniture into which a specific immobilizing unit is built.

The problem appears when it is desired that the cabinet be modular, that is, when the dimension of a specific cabinet for a specific user is obtained by the addition, in continuity, of several cabinet module-units.

Until now the cabinet could be modular, but the immobilization system is not; this is where the problem appears.

No known system has a modular immobilization system which in continuity adapts to the requirements of a modular cabinet.

The unresolved problem in current solutions is modularity: when modular cabinets are stacked the solutions for locking/immobilization with anti-overturn are independent for each module.

The object of the invention resolves this problem of modularity, allowing the use of a single anti-overturn lock system in stackable modular cabinets of the type described. For this purpose, each strip has on its ends:

a) on the ends of the moveable billet, both mobile blockers equipped with both shafts opposite each other, abutted in the modular stacking of the contiguous files;

b) on their own ends, both fixed blockers crossed by the corresponding shaft of the corresponding mobile blocker, so that there is always mechanical continuity between shafts of two contiguous strips; said shafts meet alignedly abutted, one supported upon the other in continuity with the billets.

The set of strips on its end has a return spring.

In particular, the mobile blockers and the fixed blockers are identical and are positioned opposite each other on the ends of the corresponding moveable billet of each strip. With this, problems inherent in present systems are also solved, relating to the excessive number of components and the use of complex components, which are difficult to manufacture, assemble, and operate.

The technology of known solutions is maintained to the extent that the system that is the object of the invention is of the type which includes strips with immobilization devices, all of the immobilization devices of all the drawers being correlated so that the opening of one of them prevents the opening of the rest of them.

To better understand the object of this invention, a preferred practical way of making it is shown in the diagrams, subject to additional changes which do not substantially alter their fundamentals.

Figure 1:
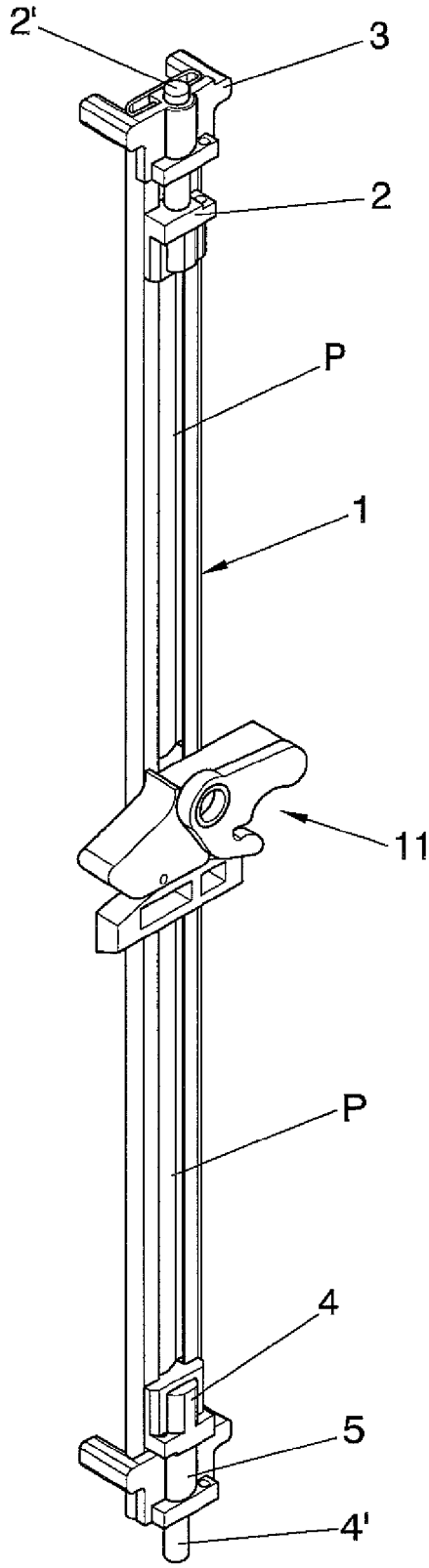
FIG. 1 is an overall schematic view of a strip (1) which includes, on its ends, the fixed blockers (3), (5) and whose moveable billets (P) include on their ends the mobile blockers (2), (4) which basically constitute the system which is the object of the invention.
Figure 2:
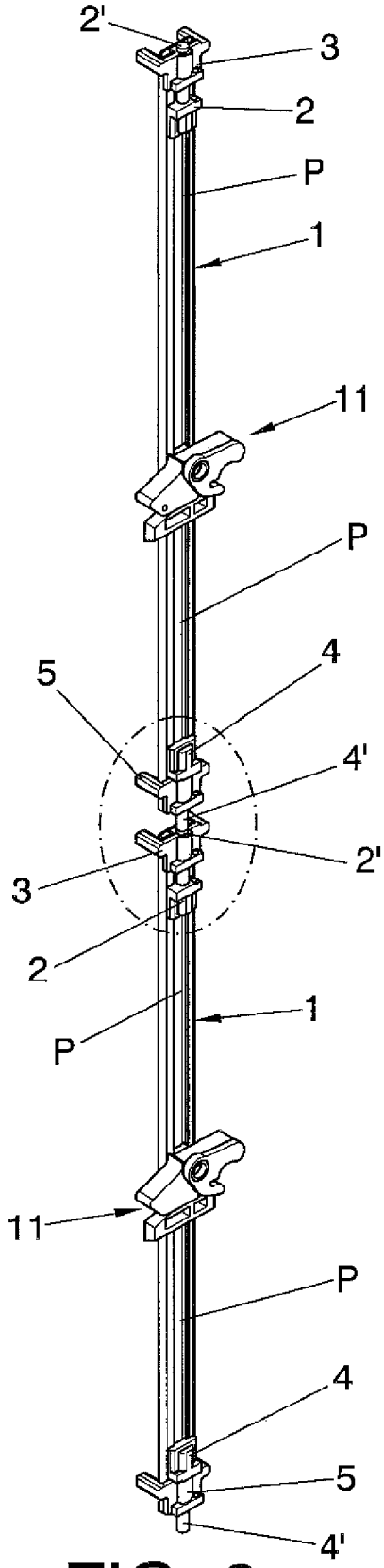
FIG. 2 is an overall view similar to FIG. 1, with two strips (1) aligned in working position.
Figure 3:
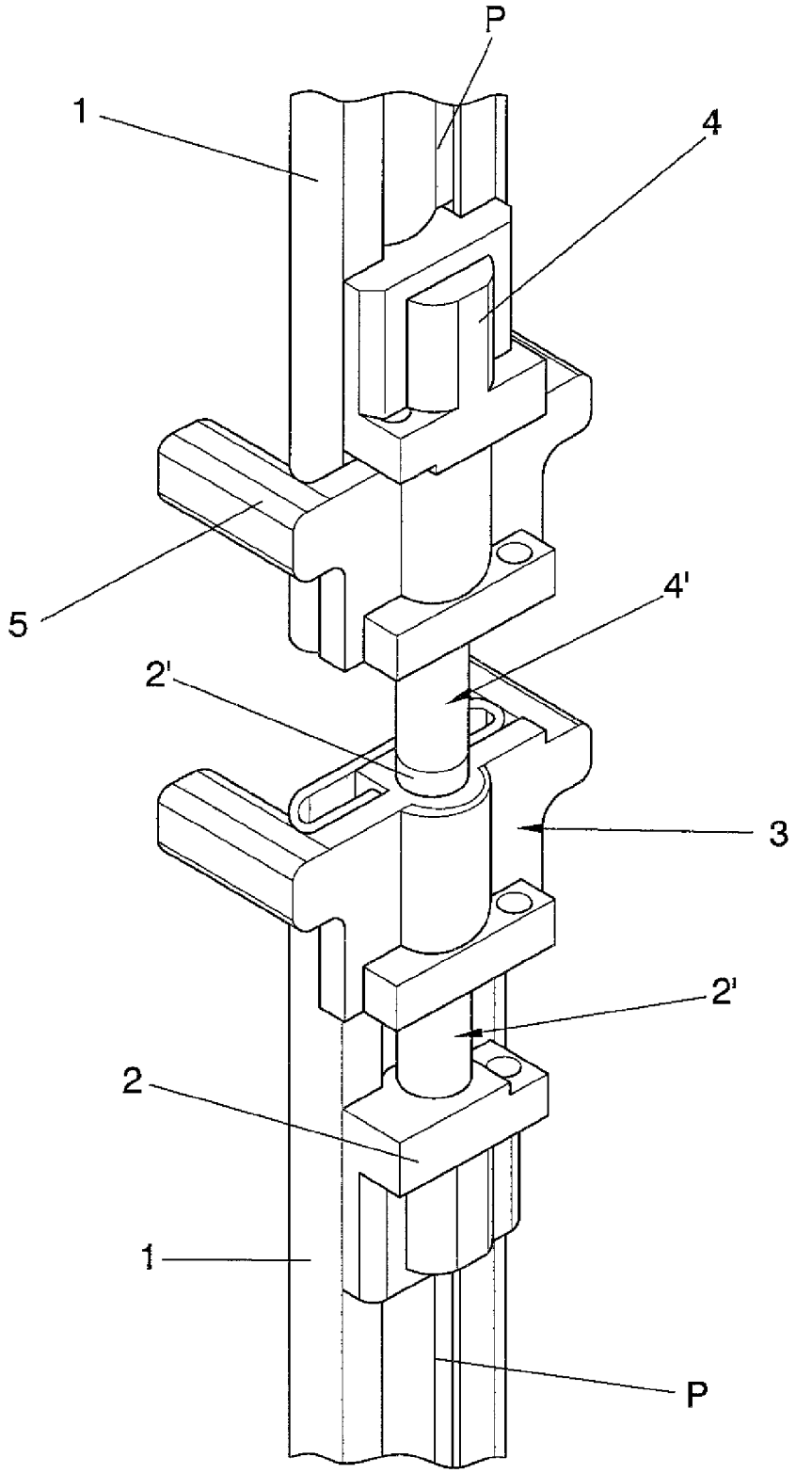
FIG. 3 is an enlarged detail, as indicated in FIG. 2.

The following is a description of an example of a practical, non-limiting way of making this invention.

The immobilizing system for stackable modular filing cabinets, according to the invention, is of the type that include strips (1) in the filing cabinet with drawers, with devices for immobilization (11) of all correlated drawers so that the opening of one of them prevents the opening of the rest of them.

In a known position the strips (1) include billets (P) which move in them. It makes no difference, and it is known, that each strip (1) incorporates a single billet (P) or several billets (P) which are moveable in continuity, meeting to abutment one upon the other.

With the use of this invention, this structuring is also applicable and operable when the filing cabinets are made up of independent, stackable modules.

According to the system which is the object of the invention, mounted in each module of filing cabinets is a strip (1) causing the strips (1) to interact in order for the system to work. For this:

The moveable billet or billets (P) of each strip (1) has on both ends mobile blockers (2), (4) each with shafts (2'), (4') opposite each other in abutment in the modular stacking of the contiguous files.

Each strip (1) has at each end, fixed blockers (3), (5) crossed through by the corresponding shaft (2'), (4') of the corresponding mobile blocker (2), (4) so that there is always continuity of contact between shafts (2'), (4') of two contiguous strips (1) the shafts of which (2'), (4') meet alignedly to abutment, one being supported upon the other.

For the system to work, there must be mechanical continuity between the billets (P) and the shafts (2'), (4') of two contiguous strips (1). The blockers (2), (4) and their shafts (2'), (4') move with the billets (P), while the fixed blockers (3), (5) are fixed to the strips (1).

Moreover, the set of strips (1)—there will be as many strips (1) as stacked modules—has at its end, a return spring, so that there is always continuity of contact between the shafts (2'), (4') facing opposite each other to abutment.

In particular, the mobile blockers (2), (4) are identical and are positioned opposite each other in pairs on the ends of the corresponding billets (P) of each strip (1); so that the shaft (2') of a blocker (2) attacks against the shaft (4') of a blocker (4) corresponding to a billet (P) of a strip (1) mounted on a following module.

Likewise, the fixed blockers (3), (5) are identical and are positioned opposite each other in pairs on the ends of each strip (1) positioning the corresponding mobile blocker (2), (4) without preventing or hindering the free movement of their respective shafts (2'), (4').

The invention claimed is:

1. An immobilizing system for a plurality of stackable modular filing cabinets, each of the stackable modular filing cabinets having a plurality of drawers, each of the stackable modular filing cabinets containing the immobilizing system, each of the stackable modular filing cabinets intercorrelated so that the opening of one of the drawers in one of the stackable modular filing cabinets prevents the rest of the drawers in the one of the stackable modular filing cabinets and each of the drawers in each of the other stackable modular filing cabinets from opening and the immobilizing system of each of the stackable modular filing cabinets comprising:

a strip comprising an elongated member having a channel, and first and second strip ends; a movable billet in said channel; immobilization devices for all the drawers;

a first mobile blocker comprising a first shaft, and a second mobile blocker comprising a second shaft, the first and second mobile blockers being on the first and second strip ends, respectively;

first and second fixed blockers aligned with each of the first and second mobile blockers, the first fixed blocker being crossed by the first shaft, and the second fixed blocker being crossed by the second shaft; the first and second fixed blockers being on the first and second strip ends, respectively;

the first shaft of a first stackable modular filing cabinet abuts the second shaft of a second, contiguously stacked modular filing cabinet, so that there is always mechanical continuity between the first and second shafts of contiguous strips corresponding to the first and second modular filing cabinets, of which the first and second shafts meet alignedly abutted, one being supported on the other in continuity with the contiguous strips.

2. The immobilizing system for stackable modular filing cabinets according to claim 1, wherein the strip has a return spring.

3. The immobilizing system for stackable modular filing cabinets according to claim 1, wherein the first and second mobile blockers are identical and are respectively positioned opposite each other on the first and second ends of the corresponding moveable strip of each billet of the first modular filing cabinet.

4. The immobilizing system for stackable modular filing cabinets according to claim 1, wherein the first and second fixed blockers are identical and are respectively positioned opposite each other on first and second ends of each billet of the first modular filing cabinet.

* * * * *